United States Patent [19]

Marsh

[11] 4,453,322

[45] Jun. 12, 1984

[54] SANDAL HAVING SIDE WALL FOR PREVENTING PRONATION

[75] Inventor: Marion Marsh, New York, N.Y.

[73] Assignee: Scholl, Inc., Memphis, Tenn.

[21] Appl. No.: 345,922

[22] Filed: Feb. 4, 1982

[51] Int. Cl.[3] ..... H43B 3/12; H43B 7/22

[52] U.S. Cl. ..... 36/11.5; 36/91; 36/93; 128/584; 128/586

[58] Field of Search ..... 128/80 D, 583, 584, 128/585, 586, 595, 615; 36/11.5, 91, 93

[56] References Cited

U.S. PATENT DOCUMENTS

| | | | |
|---|---|---|---|
| D. 217,217 | 4/1970 | Evins | 36/11.5 |
| 2,415,459 | 2/1947 | Buselmeier | 36/11.5 |
| 3,063,457 | 11/1962 | Bittner et al. | 128/615 |
| 3,121,431 | 2/1964 | Rosenhaft | 128/595 |

FOREIGN PATENT DOCUMENTS

| | | | |
|---|---|---|---|
| 2458674 | 6/1975 | Fed. Rep. of Germany | 36/44 |

*Primary Examiner*—Werner H. Schroeder
*Assistant Examiner*—Steven N. Meyers
*Attorney, Agent, or Firm*—Philip Young

[57] ABSTRACT

A sandal is provided with an inside arch and ankle stabilizing flange which forms an integral part of a one-piece molded bottom without a separate inner sole. The flange is smoothly curved and extends upward along the arch side for a longitudinal length from a point adjacent the side of the ankle stabilizes the ankle joint by preventing it from rolling inward toward the walking surface thereby providing an unusually high degree of security for an open shoe. The footbed of the molded bottom conforms to the plantar surface of the normal foot while walking or at rest. Both the bottom footbed and the upper pattern including the inner longitudinal arch flange are designed to allow for the anatomical and functional differences between the inside and outside longitudinal arch areas of the normal foot, and act to discourage the tipping of the ankle toward the inside of the foot, resulting in pronation. Also, a pair of support straps are positioned to extend from the inside arch and ankle stabilizing flange in a V-pattern to a small outside flange on the opposite side of the molded bottom and back to a point forward of and below the inside stabilizing flange near the front of the shoe, thereby properly positioning the foot and assuring a stabilizing fit.

10 Claims, 7 Drawing Figures

FIG. 1
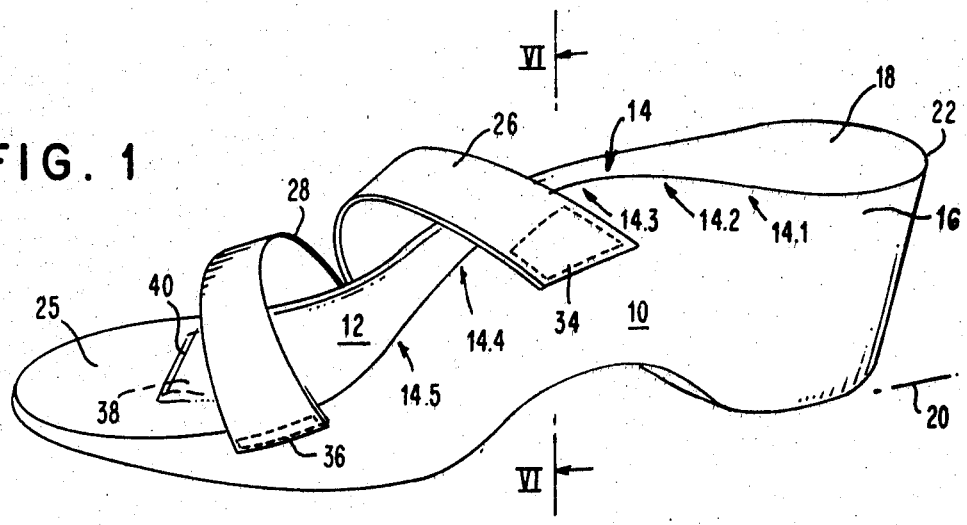
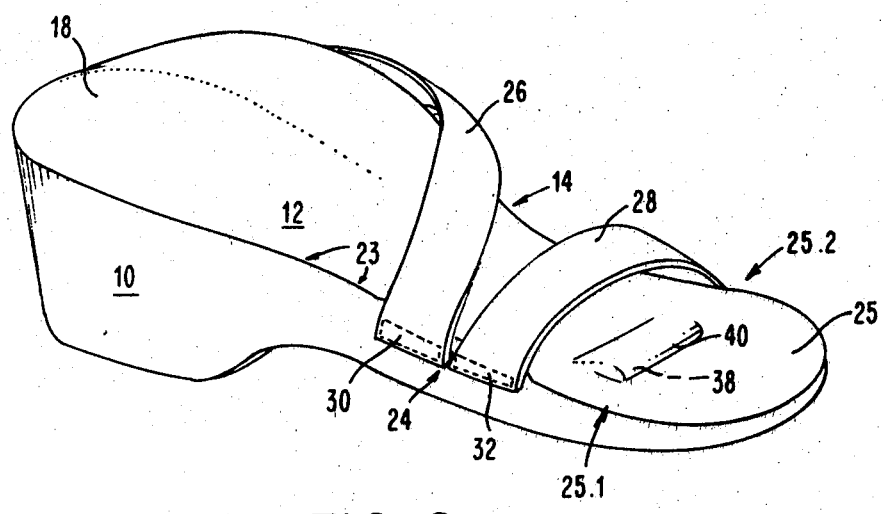
FIG. 2

SANDAL HAVING SIDE WALL FOR PREVENTING PRONATION

TECHNICAL FIELD

The present invention relates to sandals and more particularly to sandals of the one-piece molded bottom type with strap means for securing the bottom to the foot.

BACKGROUND ART

The development of sandals with one-piece molded bottoms date back in history to the use of wooden clogs, which were originally made without separate outsoles. The term "outsole" has been defined as the bottom sole thickness comprising the surface which is exposed to wear. By contrast, the conventional shoe includes an "insole" which is defined as the piece of leather or other material between the sole and the foot on to which the upper part of the shoe is connected. Within the past ten or fifteen years, as petro chemicals and other plastics have been developed for the footwear industry, the one-piece molded bottom has become common. Such one-piece molded bottom eliminates the need for separate outsoles and heels and may eliminate the need for insoles used in the conventional shoe. Also, the use of the one-piece molded bottom eliminates the requirement in some instances for steel shank requirements located under the arch.

While the above noted advantages, as well as others not mentioned, are derived from the use of the one-piece molded bottom sandal, there are certain disadvantages common to the use of such sandal. One problem arises due to the anatomical and functional differences between the inside and outside longitudinal arch areas of the normal foot, which differences cause the natural tendency of the ankle to tip toward the inside of the foot, resulting in pronation.

There are various types of insoles and inserts that have been proposed for reducing foot stresses and fatigue and for supporting parts of the feet including the arch.

In U.S. Pat. No. 2,788,591 to Gibson, there is described a sandal for supporting the arch of the foot in which a flexible strap secured to the middle portion of the sole structure provides an arch support as well as securing the sandal to the foot. The flexible strap is designed to loop around the instep of the wearer's foot, then extend around under the arch of the foot and through a slot in the flexible flap. Such straps by their very design around and under the wearer's arch would be extremely uncomfortable in actual use.

U.S. Pat. No. 4,084,333 to Del Vecchio is described as an innersole for footwear and includes a molded plastic insole shaped to the foot of the wearer. The innersole provides at its upper part, at the heel, a depression into which the foot heel portion is received and held and allows the arch of the sole to rest and adhere against the innersole. Here, the inside and outside lateral upturned walls are approximately the same height and do not allow for the physical and functional differences between the inside longitudinal arch and the commonly referred to "outer arch" at the outside edge of the foot in the area of the fifth metatarsal bone.

Also, footwear insoles are designed for insertion between the sole of a shoe and the foot. One example of an insole or insert designed for supporting the foot to relieve stresses and pressures on certain portions of the foot which cause corns, callouses and other deformities is disclosed in U.S. Pat. No. 2,008,207 to Greenberg. Here, a foot support is designed as an insole or an insert for conventionally constructed closed shoes. The design and manufacture of closed shoes, including the lasts, bottom patterns, shoe uppers, and construction techniques, are acknowledged to be different from those customarily used in open shoes and sandals. For example, inserts cannot be used in sandals. The patentee states that the insole with high inside portions tends to throw excessive weight on the fifth or little toe at the outside of the foot. To overcome this problem, the patentee provides an elevated outside portion on the insert near such little toe to support the anterior transverse arch near such little toe. The design of insoles and inserts for closed shoes does not solve the problems inherent in sandals and the one-piece molded bottom, namely the tipping of the ankle toward the inside of the foot, causing pronation, and the securing of the foot to the molded bottom is a stabilizing fit.

U.S. Pat. No. 4,020,569 to Fukuoka relates to a sole including an outersole, an insole and a heel section of a footwear such as a shoe or a sandal. A reinforcing plate also serves as an insole which is mounted on the rear half of the sole body. The reinforcing plate represents the art and complex structure involved in designing a rigid or semi-rigid reinforcing means into the rear half of a sole body to reduce foot fatigue.

It is an object of the present invention to provide a sandal which discourages or prevents tipping of the ankle toward the inside of the foot thus preventing pronation. It is another object to provide a sandal which promotes ankle stability. It is another object to provide a sandal of the one-piece molded bottom type which is designed to accommodate the anatomical and functional differences between the inside and outside longitudinal arch areas of the normal foot. It is a further object to provide a sandal which is both functional and comfortable and assures both proper positioning of the foot on the molded bottom as well as a stabilizing fit thereon.

It is to be understood that as used herein, the terms "stabilizing wall" and "stabilizing flange" are used interchangeably.

DISCLOSURE OF THE INVENTION

These and other objects are achieved by the present invention which provides a sandal with a vertical side wall which forms an integral part of a one-piece molded bottom without a separate inner sole. The one-piece molded bottom including a footbed portion which faces and comes into contact with the foot, a heel seat portion at the back of the molded bottom on which the heel is seated, and a front footbed portion at the front of the molded bottom located under the ball of the foot and the toes. The vertical side wall is smoothly curved and extends upward along the arch side for a longitudinal length from a point adjacent the side of the ankle to the area at the front foot section of the arch. The vertical side wall stabilizes the ankle joint by preventing it from rolling inward toward the walking surface thereby providing an unusually high degree of security for an open shoe.

The footbed of the molded bottom conforms to the plantar surface of the normal foot while walking or at rest. Both the bottom footbed and the upper pattern including the vertical side wall are designed to allow for the anatomical and functional differences between the inside and outside longitudinal arch areas of the normal foot, and act to discourage the tipping of the ankle toward the inside of the foot, resulting in pronation. Also, a pair of support straps are positioned to extend from the top of the vertical side wall in a V-pattern to a small outside flange on the opposite side of the molded bottom and back to a point forward of and below the vertical side wall near the front of the shoe, thereby properly positioning the foot and assuring a stabilizing fit.

BRIEF DESCRIPTION OF THE DRAWINGS

FIG. 1 shows the sandal from the side view taken from the angle facing the inside of the foot, illustrative of the present invention;

FIG. 2 is a side view of the center of the sandal shown in FIG. 1, with a view taken from the outside portion of the foot;

BEST MODE FOR CARRYING OUT THE INVENTION

Referring to the FIGS. 1 and 2 there is shown the sandal in accordance with the present invention which includes a one-piece molded bottom 10 which may be made of polyurethane or similar compounds formulated for stability in the heel and arch area with moderate flexibility in the forepart to accommodate the natural flexion of the walking foot. The one-piece molded bottom 10 obviates the need for a separate outsole, midsole and insole used in conventional shoemaking and eliminates the friction and wear difference normally experienced when they are separate parts of a footwear item. The one-piece footwear also eliminates, in some cases, the need for steel shank reinforcements under the arch and heel portions of shoes. If desired, replaceable sock linings made of leather, fabric or man-made materials can be employed. The footbed portion 12 of the molded bottom 10, representing that portion of the molded bottom which is closest to the foot is shaped to conform anatomically to a normal, non-pronating footprint and to encourage proper foot function. Specific details of the footbed 12 will be provided below.

Figure 5:
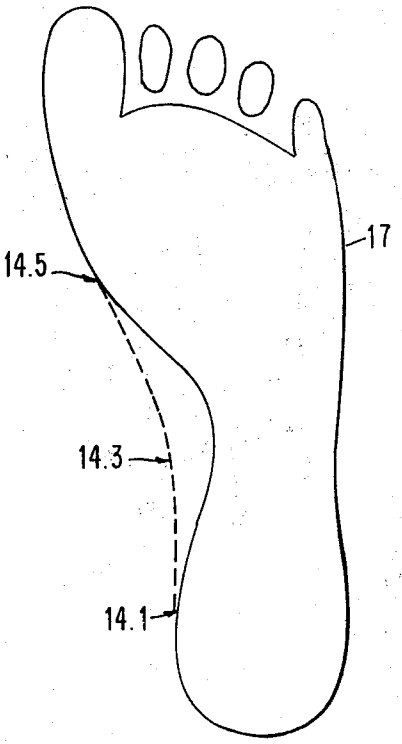
FIG. 5 is an outline drawing of the plantar surface of the normal footprint and illustrates the vertical side wall positioning relative to the plantar surface.

A vertical side wall or flange 14 is raised in a concave shape as it extends upward along the inner arch side above the sole for a longitudinal length extending from a point 14.1 adjacent the side of the ankle or heel portion 16 of the molded bottom upwards in a curved fashion through point 14.2 to a top portion 14.3 of the raised arch flange from where the flange smoothly curves downward and longitudinally forward through point 14.4 to the area around point 14.5 of the flange at the front foot section of the arch. These points 14.1-14.5 extend along the outer edge of the longitudinal length of the flange 14 and are also indicated in FIG. 5 to illustrate their relationship to the plantar surface of the normal footprint 17.

Figure 3:
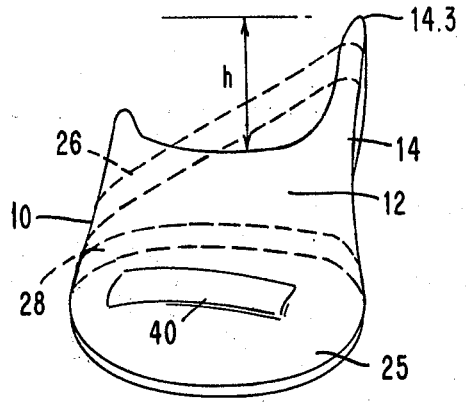
FIG. 3 is a front view of the one-piece molded bottom showing the contour of the vertical side wall of such molded bottom.
Figure 4:
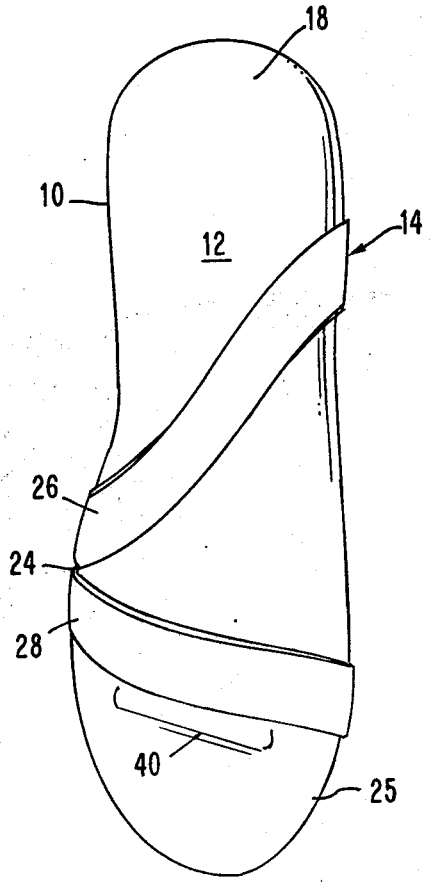
FIG. 4 is a prospective top view of the one-piece molded bottom shown in FIG. 3.
Figure 6:
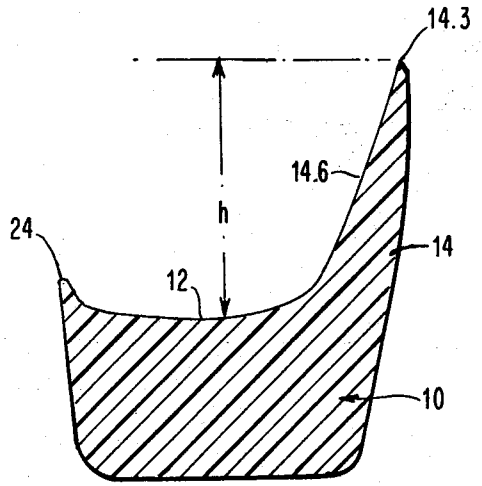
FIG. 6 is a cross-sectional view of the sandal taken through the section lines VI—VI of the sandal in FIG. 1.

The vertical side wall or flange 14 is raised in a smoothly curved fashion, as shown in FIGS. 1 and 2 as well as in the front, top and cross-sectional views of the sandal shown in FIGS. 3, 4 and 6, respectively, so that it provides stability for the ankle joint by preventing it from rolling inward, or pronating, toward the walking surface, thereby providing stability and security heretofore not afforded by an open shoe. The stabilizing wall or flange 14 is an integral part of the one-piece molded bottom 10 and is curved in a concave shape inward towards the center longitudinal line, indicated by dotted line 16 in FIGS. 3 and 6, so that it functions as an arch for the inside arch area of the foot. Flange 14 also curves upward to an average height h above the footbed 12 near the arch portion so that it functions to stabilize the ankle joint by preventing the ankle from rolling inward as it has a natural tendency to do when a person is standing or walking in a sandal. As noted above, the flange 14 is also referred to herein as an upward or vertical side wall and, therefore, such terms "flange" and "vertical side wall" are used interchangeably herein.

Figure 7:
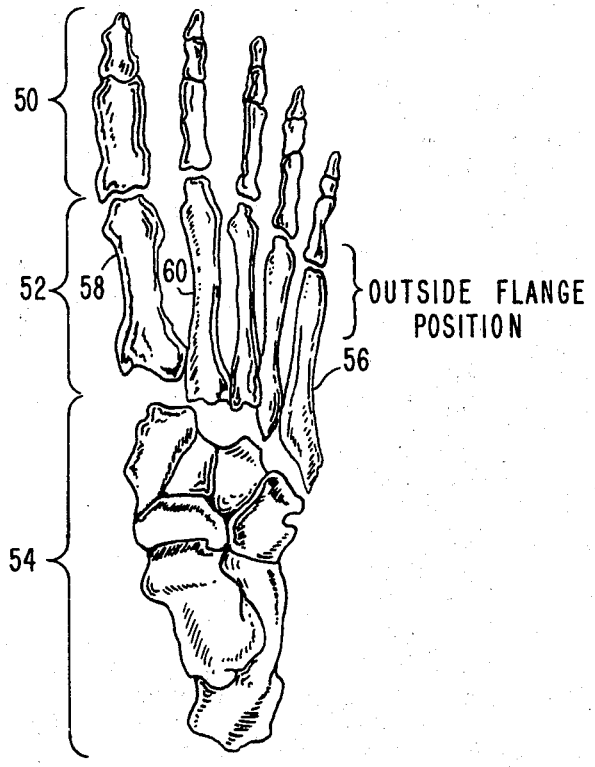
FIG. 7 is a drawing of the anatomy of the foot.

It is noted that the use of such ankle stabilizer 14 along the inner longitudinal arch acts to stabilize the ankle without impinging on the fifth metatarsal bone 56, shown in FIG. 7, at the outer portion of the foot which might otherwise occur if an outer flange were to be additionally used opposite to and symmetric with the inner flange 14. The inside longitudinal arch is a true arch requiring support at the inside of the foot as opposed to the so-called outside longitudinal arch which is not a true arch and lies in the area of the fifth metatarsal bone. Thus, any attempt for a pronounced arch or sole on the outside of the foot may result in irritation and discomfort at such area.

The one-piece molded bottom 10 comprises, in addition to the footbed 12 and the inner longitudinal stabilizing wall and flange 14, a heel seat 18 having a rounded back and a general concave shape to allow for the natural expansion of the human heel on weight impact. The heel height, measured from the walking surface 20 to the rear portion 22 of the heel seat 18, may vary from about 1½ to 2½ inches with a corresponding adjustment in the measurements of the footbed 12 and the inner longitudinal arch flange 14.

FIG. 7 is provided to assist in more clearly understanding of the anatomy of the foot and the anatomical and functional differences between the inside and outside longitudinal arch areas. There are 26 bones in each foot, divided into three sections, these being the phalanges or toe bones 50, the metatarsals 52 which are the five long bones extending from the base of the toe bones and going back toward the heel, and the tarsals 54 which are the seven chunky bones in the heel area. The bone structure is held together by ligaments, with a secondary role played by muscles and tendons. The most powerful ligament in the entire body is the plantar fascia, which fans out across the entire sole of the foot from the heel bones to just behind the toes. There are three so-called "arches", the inner and outer longitudinal arches and the metatarsal arch. However, only the commonly known "arch" or inner longitudinal arch functions as a true arch in walking. The outer longitudinal arch is that portion of the foot near the fifth metatarsal bone 56 and extends back to the tarsal bones 54 at the outside portion of the foot. The impression made by a normal, adult bare foot in walking clearly demonstrates that the inner longitudinal arch does not come in contact with the walking surface. In walking, the heel receives and absorbs the initial impact. Weight is then tranferred through the foot to the toes, which are used to push off for the next step.

An outer longitudinal area 23 is located along the outer part of the footbed portion 12 and is flatter and more depressed than a typical arch and does not function as an arch as it extends from the forward part of the fifth metatarsal bone 56 back to the outer portion of where the tarsal, heel bones 54 lie on the footbed 12. The outer longitudinal area 23 allows for the normal transfer of weight from the heel to the forward part or ball of the foot. Also, the footbed 12 includes a front portion 25 located under the ball of the foot at the front of where the metatarsal bones are situated. The front footbed 25 is the portion to which body weight is transferred and is suitably depressed in the areas to accommodate the increased dimension of the weight bearing foot. The front footbed portion 22 is slightly higher in the outside area shown as 25.1 located under the front of the fifth metatarsal 56, tapering lower toward the inside area 25.2 under the front of the first metatarsal 58 to aid in the transfer of weight to the stronger inner portion of the fore-foot.

A small upward outside flange 24 is formed at the end of the outer longitudinal area 23 located at the side of the fifth metatarsal bone 56. This upward flange 24 is adapted to permit attachment of the one-piece molded bottom 10 with the upper, which in this case comprises straps 26 and 28 attached at points 30 and 32 respectively to the outside flange 24. Flange 24 also provides security for the outside vamp of the sandal. Flange 24 is provided at a low height to avoid any restriction or pressure on the enlarged back part of the fifth metatarsal bone, thus avoiding distortion or discomfort in this area. Sandal straps 26 and 28 are respectively connected at the outer ends 34 and 36 to the upper portion of the inner longitudinal flange 14 and the front, forward portion thereof, respectively. Straps 26 and 28 are shown in a V-configuration.

A toe gripper bar 38 comprising an elevation area of the footbed 12 is provided in the footbed between the second metatarsal bone 60 and fifth metatarsal 56 and the second and fifth of the phalangeal or toe bones 50, and conforms with the plantar surface of the foot. In the area 40 under the first metatarsal 58 and big toe bone, there is a slight depression to accommodate the action of the large toe in pushing off at the conclusion of a step. The toe-gripper bar portion 38 also serves to position the foot properly in the shoe, and prevents it from sliding forward or back while walking. The use of a toe-gripper bar and a depression area similar to those described above are disclosed in U.S. Pat. No. 3,063,457 to E. Bittner et al.

The upper pattern of the footbed 12 is designed to properly position the foot and to provide a stabilized fit. Placement of the straps 26 and 28 enforces the security of the inner longitudinal arch flange 14 and allows natural walking motion with weight transferred without impingement on any sensitive area of the foot. The same principle may be extended to other open or closed sandal designs, including sandals with adjustable straps.

FIG. 6 is a cross-sectional view of the sandal taken through the section lines VI—VI of the sandal in FIG. 1. Here, the inner longitudinal arch flange 14 has a concave shape as it extends upward along the inner arch side 14.6 to the top portion 14.3 of the flange. By contrast, the outer longitudinal area 20 shown in FIG. 2 is provided with the relatively small, outside flange 24 at the point adjacent to where the side of the fifth metatarsal bone 56 will rest on the footbed 12 of the one-piece molded bottom 10. Thus, it can be seen that the inner longitudinal flange 14 curved and raised significantly above the sole to provide stability for the ankle joint and prevent it from rolling inward or pronating toward the walking surface. Also, the fact that an open shoe or sandal can provide this stability and security offers significant advantages and comfort to the foot. In addition, the substantially smaller outside flange 24 located at the side of the fifth metatarsal bone is sufficient to permit attachment of the sole to the upper straps and provides security for the sandal while at the same time being such as to avoid any construction or pressure on the enlarged back part of the fifth metatarsal bone 56, thereby avoiding distortion or discomfort in this critical area.

While the invention has been described above with respect to its preferred embodiments, it should be understood that other forms and embodiments may be made without departing from the spirit and scope of the invention.

What is claimed is:

1. A sandal comprising:

a one-piece molded bottom including a footbed portion which faces and comes into contact with the foot, a front footbed portion at the front of said molded bottom located under the ball of the foot and the toes, and an elevated heel portion at the back of said molded bottom;

a substantially vertical, rigid side wall which extends up from and forms an integral part of said molded bottom, a top edge of said vertical side wall being smoothly curved and extending upward along the arch side of said molded bottom for a longitudinal length extending from a point adjacent said heel portion to said front footbed portion, said vertical side wall being of sufficient height above the foot bottom surface to provide stability for the ankle joint by preventing it from rolling inward toward the walking surface; and support strap means positioned to extend from the top of said vertical side wall to the opposite side of said molded bottom at an outside foot portion thereof to properly position and maintain the foot in contact with both said vertical side wall and the footbed portion of said molded bottom during walking and assure a stabilizing fit.

2. A sandal as recited in claim 1, wherein said vertical side wall extends upward along the arch side in a concave shape to a top portion which is at a substantial height h above said footbed portion for stabilizing the ankle joint and preventing it from rolling inward toward the walking surface.

3. A sandal as recited in claim 2, wherein said support strap means includes a strap attached from said top portion of said vertical side wall to the opposite side of said molded bottom at an outside foot portion thereof.

4. A sandal as recited in claim 1, further comprising an outside flange extending from the outside portion of said molded bottom near the outside of a vamp area diagonally opposite to the location of said vertical side wall, said outside flange being small and low in height relative to said vertical side wall to avoid causing pressure on the fifth metatarsal bone of the sandal wearer.

5. A sandal as recited in claim 4, wherein said support strap means are attached between said vertical side wall and said outside flange.

6. A sandal as recited in claim 5, wherein said support strap means includes a pair of straps connected from said outside flange to said vertical side wall in a V-pattern.

7. A sandal as recited in claim 1, wherein said heel portion includes a heel seat in said footbed, and said front footbed portion includes an elevated portion which conforms with the plantar surface of the foot at the toe bones, and a depressed portion under the area where the big toe is seated.

8. A sandal as recited in claim 1, wherein said elevated heel portion is at least one and one half inches high.

9. A sandal as recited in claim 1, wherein said vertical side wall is made of polyurethane in substantially rigid form for retaining and supporting the ankle joint and thereby preventing said ankle joint from rolling inward.

10. A sandal as recited in claim 1, wherein said one-piece molded bottom and said vertical side wall, forming an integral part of said one-piece molded bottom, are both made of polyurethane in substantially rigid form.

* * * * *